US012416177B1

(12) United States Patent
Goedecke

(10) Patent No.: US 12,416,177 B1
(45) Date of Patent: Sep. 16, 2025

(54) FENCE SYSTEM AND METHOD, AND FENCE POST ASSEMBLY THEREFOR

(71) Applicant: Bullet Fence Systems, LLC, Okmulgee, OK (US)

(72) Inventor: Ronald D. Goedecke, Okmulgee, OK (US)

(73) Assignee: Bullet Fence Systems, LLC, Okmulgee, OK (US)

( * ) Notice: Subject to any disclaimer, the term of this patent is extended or adjusted under 35 U.S.C. 154(b) by 0 days.

(21) Appl. No.: 19/032,352

(22) Filed: Jan. 20, 2025

(51) Int. Cl.
*E04H 17/14* (2006.01)

(52) U.S. Cl.
CPC ..... *E04H 17/1473* (2021.01)

(58) Field of Classification Search
CPC ..... E04H 17/1452; E04H 17/1456; E04H 17/1473; E04H 17/1488; E04H 17/16; E04H 17/168; E04H 17/17; E04H 17/21
See application file for complete search history.

(56) References Cited

U.S. PATENT DOCUMENTS

| | | | | |
|---|---|---|---|---|
| 1,310,380 | A | 7/1919 | Whittingham | |
| 2,150,291 | A | 3/1939 | Paque | |
| 2,520,313 | A * | 8/1950 | Harris | E04H 17/1447 256/22 |
| 2,764,438 | A | 9/1956 | Haviland | |
| 3,092,407 | A | 6/1963 | Blonder | |
| 3,285,576 | A | 11/1966 | Clark | |
| 3,442,110 | A | 5/1969 | Walton et al. | |
| 5,297,890 | A | 3/1994 | Commins | |
| 5,961,242 | A | 10/1999 | Leone | |
| 6,386,519 | B1 | 5/2002 | Priefert | |
| 6,530,561 | B2 | 3/2003 | Larsen et al. | |
| 7,571,897 | B2 | 8/2009 | Heinz | |
| 8,914,660 | B2 | 12/2014 | Tanaka | |
| 10,612,269 | B2 * | 4/2020 | Parisien | E04H 17/009 |
| 10,676,958 | B2 | 6/2020 | Short et al. | |
| 10,760,298 | B2 | 9/2020 | Crandall et al. | |
| 11,549,280 | B1 * | 1/2023 | Walker | E04H 17/168 |
| 11,578,502 | B2 | 2/2023 | Naylor | |
| 11,891,831 | B1 * | 2/2024 | Hudson | E04H 17/16 |
| 2012/0138758 | A1 * | 6/2012 | Graber | E04H 17/1417 248/221.11 |

FOREIGN PATENT DOCUMENTS

| | | | | |
|---|---|---|---|---|
| FR | 2741903 | A1 * | 6/1997 | E04H 17/1413 |
| FR | 2896282 | | 7/2007 | |
| FR | 2958674 | A3 * | 10/2011 | E04H 17/009 |
| FR | 3100831 | A1 * | 3/2021 | E04H 17/20 |

(Continued)

OTHER PUBLICATIONS

Master Halco—Postmaster Fence System—Installation Guidline Sheets; www.masterhalco.com.

*Primary Examiner* — Jonathan P Masinick
(74) *Attorney, Agent, or Firm* — Dennis D. Brown; Brown Patent Law, P.L.L.C.

(57) ABSTRACT

A fence system and method using hat-channel fence post assemblies in which elongate inner hat-channel members are nested in outer hat-channel members to form adjustable, longitudinally extending side gaps for receiving and clamping the ends or edges of horizontal boards, wire screens, or other fence filler materials.

20 Claims, 6 Drawing Sheets

(56) References Cited

FOREIGN PATENT DOCUMENTS

| | | | | | |
|---|---|---|---|---|---|
| FR | 3142208 | | | 5/2024 | |
| GB | 1547982 | A | * | 7/1979 | ..... E04H 17/1452 |
| GB | 2089881 | A | * | 6/1982 | ..... E04H 17/16 |
| GB | 2116597 | | | 3/1983 | |
| GB | 2199601 | | | 2/1988 | |
| GB | 2300435 | | | 6/1996 | |
| GB | 2466778 | A | * | 7/2010 | ..... E04H 17/21 |
| GB | 2509195 | A | * | 6/2014 | ..... E04H 17/21 |
| GB | 2570912 | | | 8/2019 | |
| GB | 2570912 | A | * | 8/2019 | ..... E04H 17/143 |
| KR | 20040011053 | A | * | 2/2004 | ..... E04H 17/1452 |

* cited by examiner

FENCE SYSTEM AND METHOD, AND FENCE POST ASSEMBLY THEREFOR

FIELD OF THE INVENTION

The present invention relates to fence systems and methods, and to fence post assemblies for fence systems.

BACKGROUND OF THE INVENTION

A continuing need exists for improved fence systems and methods for residential and other uses. The improved fence systems will preferably be lower cost, less complicated, and easier to install. The improved fence systems will also preferably provide: greater strength and durability; improved weather resistance; a better appearance; and new options for the design and appearance of the fence system.

In constructing fences for residential and other purposes, various types of fence posts are commonly used in the art. One type of fence post currently used in the art is a metal, hat-channel fence post wherein a U-shaped channel extends longitudinally along the entire vertical length of the post. Hat-channel fence posts are commercially available, for example, from Master Halco and other manufactures.

Hat-channel fence posts are sturdy and highly weather-resistant. They also provide fence systems which are durable and very attractive. Unfortunately, however, hat-channel fence systems have heretofore been complicated, labor intensive, time consuming, and costly to install.

By way of example, in a typical fence system using hat-channel fence posts, once the lower ends of the posts have been installed in the ground, it has been necessary to (i) cut wooden kickboards for the fence and then screw the kickboards to the posts such that the kickboards run horizontally at ground level, (ii) cut two elongate wooden "nailer" pieces for each hat-channel post and screw the nailers onto the posts so that they run vertically on each side of the U-shaped channels, (iii) nail the ends of horizontal fence boards (i.e., the horizontal fence filler material extending between the posts) to the vertical nailers, and (iv) cut and attach other wooden filler and cover pieces to the fence.

Consequently, a need particularly exists for an improved fence system using hat-channel fence posts wherein the fence system (a) is equally or more attractive and durable than the prior hat-channel fence systems but (b) is significantly less complicated, costly, time consuming, and labor intensive to install.

SUMMARY OF THE INVENTION

The present invention provides a fence system and method, and a hat-channel fence post assembly therefor, which alleviate the problems and satisfy the needs mentioned above. The inventive fence system and post assembly: (i) cost less than prior hat-channel systems and assemblies, (ii) are easier and quicker to install, (iii) provide an appearance which is better and/or different than prior fence systems, (iv) allow the use of readily available and lower cost post and fence materials, (v) are adaptable for holding horizontal wooden boards, panels, or slats, woven fence or screening materials, welded wire panels, and any other filler materials having a wide range of thicknesses (e.g., from as little as 0.5 inch or less to as much as 1.0 inch or more) for the body of the fence, and (vi) allow the post assembly and fence to be installed without welding.

In one aspect, there is provided a fence post assembly which preferably comprises an inner hat-channel member and an outer hat-channel member. Each of the inner and the outer hat-channel members preferably comprises a U-shaped channel which extends longitudinally from a lower end to an upper end of the hat-channel member. The U-shaped channel preferably has (i) a longitudinally extending channel opening in a forward face of the hat-channel member and (ii) a longitudinally extending back wall opposite the longitudinally extending channel opening. Each of the inner and outer hat-channel members also comprises longitudinally extending left and right side flanges which project outwardly on opposite left and right sides of the longitudinally extending channel opening of the U-shaped channel.

The U-shaped channel of the inner hat-channel member has an outer lateral width that is less than the inner lateral width of the U-shaped channel of the outer hat-channel member so that at least a longitudinal portion of the back wall of the U-shaped channel of the inner hat-channel member is received in the longitudinally extending channel opening of the U-shaped channel of the outer hat-channel member and nests in the U-shaped channel of the outer hat-channel member. This forms (i) a first longitudinally extending side gap, between the left side flange of the inner hat-channel member and the left side flange of the outer hat-channel member, for receiving a fence filler material and (ii) a second longitudinally extending side gap, between the right side flange of the inner hat-channel member and the right side flange of the outer hat-channel member, for receiving a fence filler material.

In another aspect, there is provided a fence which preferably comprises a fence post assembly, a first fence filler material, and a second fence filler material. The fence post assembly preferably comprises an inner hat-channel member and an outer hat-channel member, wherein each of the inner and the outer hat-channel members preferably comprises a U-shaped channel which extends longitudinally from a lower end to an upper end of the hat-channel member, the U-shaped channel having (i) a longitudinally extending channel opening in a forward face of the hat-channel member and (ii) a longitudinally extending back wall opposite the longitudinally extending channel opening. Each of the inner and outer hat-channel members also comprises longitudinally extending left and right side flanges which project outwardly on opposite left and right sides of the longitudinally extending channel opening of the U-shaped channel.

The U-shaped channel of the inner hat-channel member has an outer lateral width that is less than the inner lateral width of the U-shaped channel of the outer hat-channel member so that at least a longitudinal portion of the back wall of the U-shaped channel of the inner hat-channel member is received in the longitudinally extending channel opening of the U-shaped channel of the outer hat-channel member and nests in the U-shaped channel of the outer hat-channel member. This forms (i) a longitudinally extending left side gap between the left side flange of the inner hat-channel member and the left side flange of the outer hat-channel member and (ii) a longitudinally extending right side gap between the right side flange of the inner hat-channel member and the right side flange of the outer hat-channel member.

The first fence filler material has an end portion or edge portion which is received in the left side gap and the second fence filler material has an end portion or edge portion which is received in the right side gap. The second fence filler material can be of a same type as, or different from, the first fence filler material.

In another aspect, there is provided a fence which preferably comprises a first fence post assembly, a second fence post assembly, and a fence filler material. Each of the first fence post assembly and the second fence post assembly preferably comprises an inner hat-channel member and an outer hat-channel member wherein each of the inner and outer hat-channel members comprises a U-shaped channel which extends longitudinally from a lower end to an upper end of the hat-channel member. The U-shaped channel has (i) a longitudinally extending channel opening in a forward face of the hat-channel member and (ii) a longitudinally extending back wall opposite the longitudinally extending channel opening. Each of the inner hat-channel member and the outer hat-channel member also has longitudinally extending left and right side flanges which project outwardly on opposite left and right sides of the longitudinally extending channel opening of the U-shaped channel.

For each of the first fence post assembly and the second fence post assembly, the U-shaped channel of the inner hat-channel member preferably has an outer lateral width that is less than the inner lateral width of the U-shaped channel of the outer hat-channel member so that for each of the first fence post assembly and the second fence post assembly, at least a longitudinal portion of the back wall of the U-shaped channel of the inner hat-channel member is received in the longitudinally extending channel opening of the U-shaped channel of the outer hat-channel member and nests in the U-shaped channel of the outer hat-channel member. This forms (i) a longitudinally extending left side gap between the left side flange of the inner hat-channel member and the left side flange of the outer hat-channel member and (ii) a longitudinally extending right side gap between the right side flange of the inner hat-channel member and the right side flange of the outer hat-channel member.

The fence filler material has (i) a left end portion or edge portion which is received in the right side gap of the first fence post assembly and (ii) a right end portion or edge portion which is received in the left side gap of the second fence post assembly.

Further objects, features, and advantages will be apparent to those in the art upon reviewing the accompanying drawings and upon reading the following Detailed Description of the Preferred Embodiments.

DETAILED DESCRIPTION OF THE PREFERRED EMBODIMENTS

Figure 1:
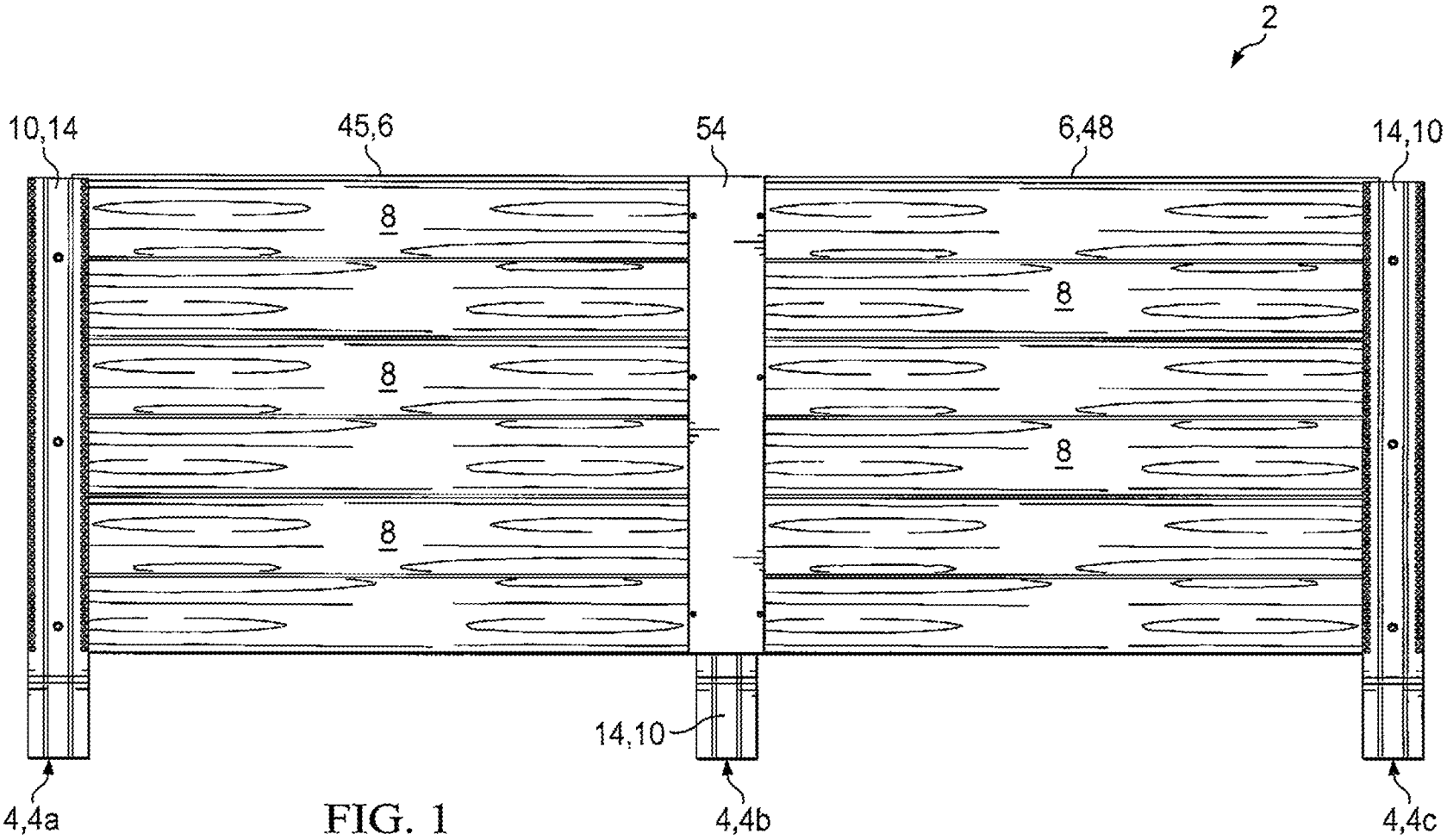
FIG. 1 is a forward (front) elevational view of an embodiment 2 of the fence system provided by the present invention.

An embodiment 2 of the inventive fence system is illustrated in FIGS. 1-6. The inventive fence system 2 preferably comprises: (a) a series of inventive vertical fence post assemblies 4 (shown as a sequence of the post assemblies 4*a*, 4*b*, 4*c*) and (*b*) a series of segments 45 and 48 of fence filler material 6 which are held by and extend horizontally between the fence post assemblies 4.

As used herein and in the claims, unless otherwise stated, the term "horizontal" when used in reference to the fence filler material 6, or to the inventive fence system 2 or the features thereof in general, includes both (i) a non-angled, strictly horizontal orientation as well as (ii) a horizontal orientation which is angled to a degree needed to adapt to the slope of the terrain.

The fence filler material 6 used in the inventive fence system 2 can be generally any type of fencing material used in the art to provide the body of the fence 2 which fills the horizontal segments between the fence posts 4*a*, 4*b*, 4*c*. Moreover, because of the adjustability of the widths of the left and right-side gaps 40 and 42 (discussed below) of the fence post assemblies 4 for receive and clamping the filler materials 6, the thickness of the filler material 6 can range from less than 0.5 to more than 1.0 inch.

By way of example, but not by way of limitation, examples of fence filler materials 6 preferred for use in the inventive fence system 2 include (i) a vertical series of horizontal boards, planks, or panels 8, (ii) a woven fence or other screening material, or (iii) welded wire panels. If the fence filler material 6 is a vertical series of horizontal boards, planks, or panels 8, the boards, planks, or panels 8 can be (i) closely grouped together such that there are essentially no gaps between the horizontal boards, planks, or panels 8 or (i) spaced apart such that there are vertical gaps between the horizontal boards, planks, or panels 8.

Each of the inventive fence post assemblies 4 illustrated in FIGS. 1-6 preferably comprises an elongate, vertically extending inner hat-channel member 10 and an elongate, vertically extending outer hat-channel member 12. Each of the vertically extending inner and outer hat-channel members 10 and 12 preferably comprises (i) a forward face 14 which extends from the bottom end to the top end of the hat-channel member 10 or 12 and (ii) an elongate U-shaped channel 16 which also extends longitudinally from the lower end to the upper end of the hat-channel member 10 or 12.

The elongate, longitudinally extending vertical U-shaped channel 16 of each hat-channel member 10 and 12 preferably comprises (i) a longitudinally extending channel opening 18 in the forward face of the hat-channel member 10 or 12, (ii) a longitudinally extending back wall 20 which is opposite and is spaced rearwardly from the channel opening 18, (iii) a left side wall 24 which extends forwardly from the back wall 20 to the channel opening 18, (iv) a right side wall 26, opposite the left side wall 24, which extends forwardly from the back wall 20 to the channel opening 18, (v) an outer lateral width 28, and (vi) an inner lateral width 30.

The cross-sectional U-shape of the U-shaped channel 16 used in each of the inner and outer hat-channel members 10 and 12 will preferably be a rectangular U-shape wherein the back wall 20 is flat and the left and right-side walls 24 and 26 of the U-shaped channel 16 are parallel. However, by way of example but not by way of limitation, it will be understood that (i) the back wall 20 of the U-shaped channel 16 can alternatively have a curved cross-sectional shape, (ii) the left and right side walls 24 and 26 can alternatively diverge away from each other to some degree as they extend toward the channel opening 18, and/or (iii) the U-shaped channel 16 can otherwise have a more rounded or less rectangular cross-sectional shape.

Each of the inner and outer hat channel members 10 and 12 further comprises (i) a longitudinally extending left side flange 32 which extends along and projects outwardly from the left edge of the channel opening 18 and (ii) a longitudinally extending right side flange 34, opposite the left side flange 32, which extends along and projects outwardly from the right edge of the channel opening 18. For each of the inner and outer hat-channel members 10 and 12, the left side flange 32 and the right side flange 34 are preferably coplanar so that (a) the left and right side flanges 32 and 34 of the inner hat-channel member 10 lie in a first plane 36 and (b) the left and right side flanges 32 and 34 of the outer hat-channel member 12 lie in a second plane 38.

The longitudinal length of the inner hat-channel member 10 will preferably be such as to provide (i) a lower portion of sufficient length for anchoring the inner hat-channel member in the ground and (ii) an upper portion of sufficient length to provide an above-ground fence of any desired height. By way of example, but not by way of limitation, the inner hat-channel member 10 can be a commercially available metal, hat-channel fence post such as a POSTMASTER hat-channel line post sold by Master Halco. POSTMASTER hat-channel line posts are available in sizes ranging from 7.5 to 12 feet in length.

Although the outer hat-channel member 12 can also be of any length desired, the height of the outer hat-channel member 12 will more preferably be such that the outer hat-channel member 12 will only extend along all or a portion of the above-ground height of the inner hat-channel member 10 so that the outer hat-channel member 12 preferably does not extend into the ground, or preferably at least does not extend into the ground to any significant length.

The overall lateral width 41 of the forward face 14 the outer hat-channel member 12 can be somewhat different than that of the forward face 14 of the inner hat-channel member 10 but will preferably be substantially the same. However, the outer lateral width 28 of the U-shaped channel 16 of the inner hat-channel member 10 is less than the inner lateral width of the U-shaped channel 16 of the outer hat-channel member 12 so that (i) at least a longitudinal portion (e.g., preferably at least a portion of the above-ground length, and more preferably at least most of the above-ground length) of the back wall 20 of the U-shaped channel 16 of the inner hat-channel member 10 is received in the longitudinally extending channel opening 18 of the U-shaped channel 16 of the outer hat-channel member 12 and (ii) the back wall 20 of the U-shaped channel 16 of the inner hat-channel member 10 therefore nests in the U-shaped channel 16 of the outer hat-channel member 12.

It will be understood, however, the although it is preferred that the hat-channel member 10 be the longer of the two hat-channel members 10 and 12 and that the hat-channel member 10 nest in the hat-channel member 12, the hat-channel member 12 can alternatively (i) be longer than the hat-channel member 10 and/or (ii) nest in the hat-channel member 10.

The nesting of the U-shaped channel 16 of the inner hat-channel member 10 in the U-shaped channel 16 of the outer hat-channel member 12 forms (i) a longitudinally extending left side gap 40 between the left side flange 32 of the inner hat-channel member 10 and the left side flange 32 of the outer hat-channel member 12 and (ii) a longitudinally extending right side gap 42 between the right side flange 34 of the inner hat-channel member 10 and the right side flange 34 of the outer hat-channel member 12. In this arrangement, when the left and right-side flanges 32 and 34 of each of the hat-channel members 10 and 12 are coplanar, the plane 36 of the side flanges 32 and 34 of the inner hat-channel member 10 will be parallel to the plane 38 of the side flanges 32 and 34 of the outer hat-channel member 12.

In the inventive fence system 2, a right end or edge portion 44 of a first horizontal segment 45 of filler material 6 (e.g., the right end or edge 44 of a body 45 of fence filler material 6 comprising a vertical series of horizontal boards, planks, or panels 8) is received in the left side gap 40 of the fence post assembly **4*b*. Similarly, a left end or edge portion 46 of a second horizontal segment 48 of fence filler material 6 which may be the same as or different from the first segment 45 of filler material 6 (e.g., the left end or edge 46 of a body 48 of filler material 6 comprising a vertical series of horizontal boards, planks, or panels 8) is received in the right side gap 42 of the fence post assembly 4*b***.

In order to adjust the widths of the left side gap 40 and the right side gap 42 and adapt to the thickness of the filler material 6, the fence post assembly 4 further comprises a vertical series of bolts 50 which extend through the longitudinally extending back wall 20 of the U-shaped channel 16 of the outer hat-channel member 12 and the longitudinally extending back wall 20 of the U-shaped channel 16 of the inner hat-channel member 10. Nuts 52 are threaded onto the distal ends of the bolts 50 in the interior of the U-shaped channel 16 of the inner hat-channel member 10 in order to tighten the left and right side gaps 40 and 42 of the fence post assembly **4*b* for (i) clamping the right end or edge portion 44 of the first horizontal segment 45 of filler material 6 in the left side gap 40 and (ii) clamping the left end or edge portion 46 of the second horizontal segment 48 of filler material 6 in the right side gap 42**.

In order to further secure the end or edge portions 44 and 46 of the horizontal segments 45 and 48 of the filler material 6 in the side gaps 40 and 42 of the fence post assembly **4*b*, holes will preferably be provided in the left and right side flanges 32 and 34 of the inner hat-channel member 10 in order to optionally (i) extend a plurality of screws 58 through the left side flange 32 of the inner hat-channel member 10 into the right end portion or edge portion 44 of the horizontal segment 45 of fence filler material 6 and (ii) extend a plurality of screws 58 through the right side flange 34 of the inner hat-channel member 10 into the left end portion or edge portion 46 of the horizontal segment 48 of fence filler material 6**.

In order to further enhance the visual appeal of the inventive fence system 2, a cover 54 formed of a panel, board, or plank will preferably be positioned over at least a portion of the above-ground longitudinal length (height) of the forward face 14 of the inner hat-channel member 10 so that the cover 54 conceals at least a longitudinally extending portion of the forward face 14 of the inner hat-channel member 10 and also conceals the nuts 52 and the ends of the bolts 50. The lateral width 55 of the cover 54 will preferably be greater than the overall width 41 of the forward face 14 of the inner hat-channel member 10 so that the cover 54 can be attached by (i) extending a plurality of screws 56 through a left edge portion of the cover 54 into the first horizontal segment 45 of filler material 6 and (ii) extending a plurality of screws 56 through a right edge portion of the cover 54 into the second horizontal segment 48 of filler material 6.

As noted above, the inventive fence system 2 can comprise a series of any desired number of sequential identical fence post assemblies **4*a*, 4*b*, 4*c* having horizontal segments 45, 48 of fence filler material 6** extending there between.

Figure 2:
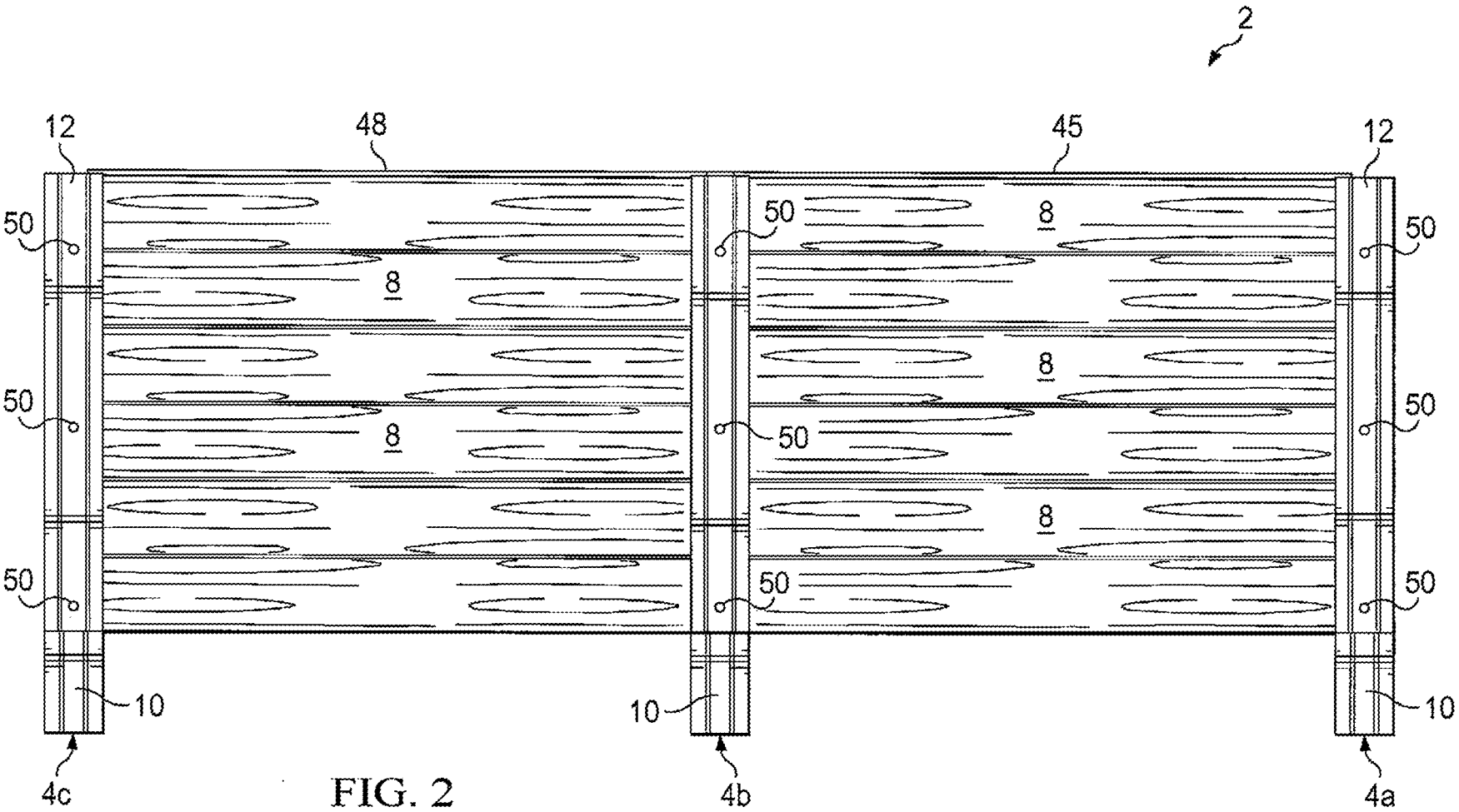
FIG. 2 is a rearward (back) elevational view of the inventive fence system 2.
Figure 3:
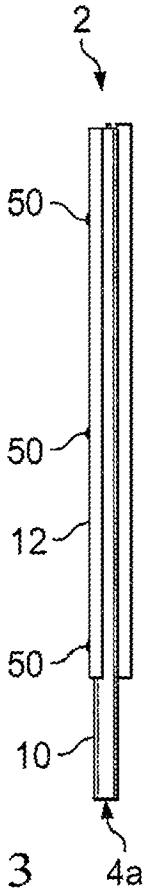
FIG. 3 is an elevational end view of the inventive fence system 2.
Figure 4:
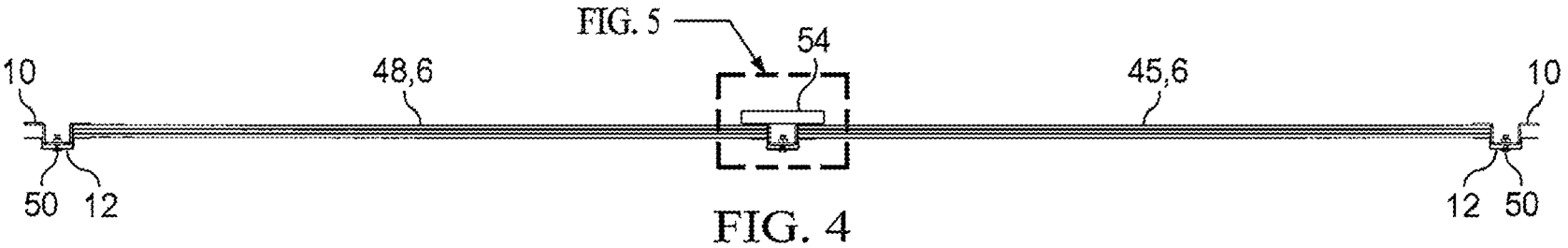
FIG. 4 is top view of the inventive fence system 2.
Figure 5:
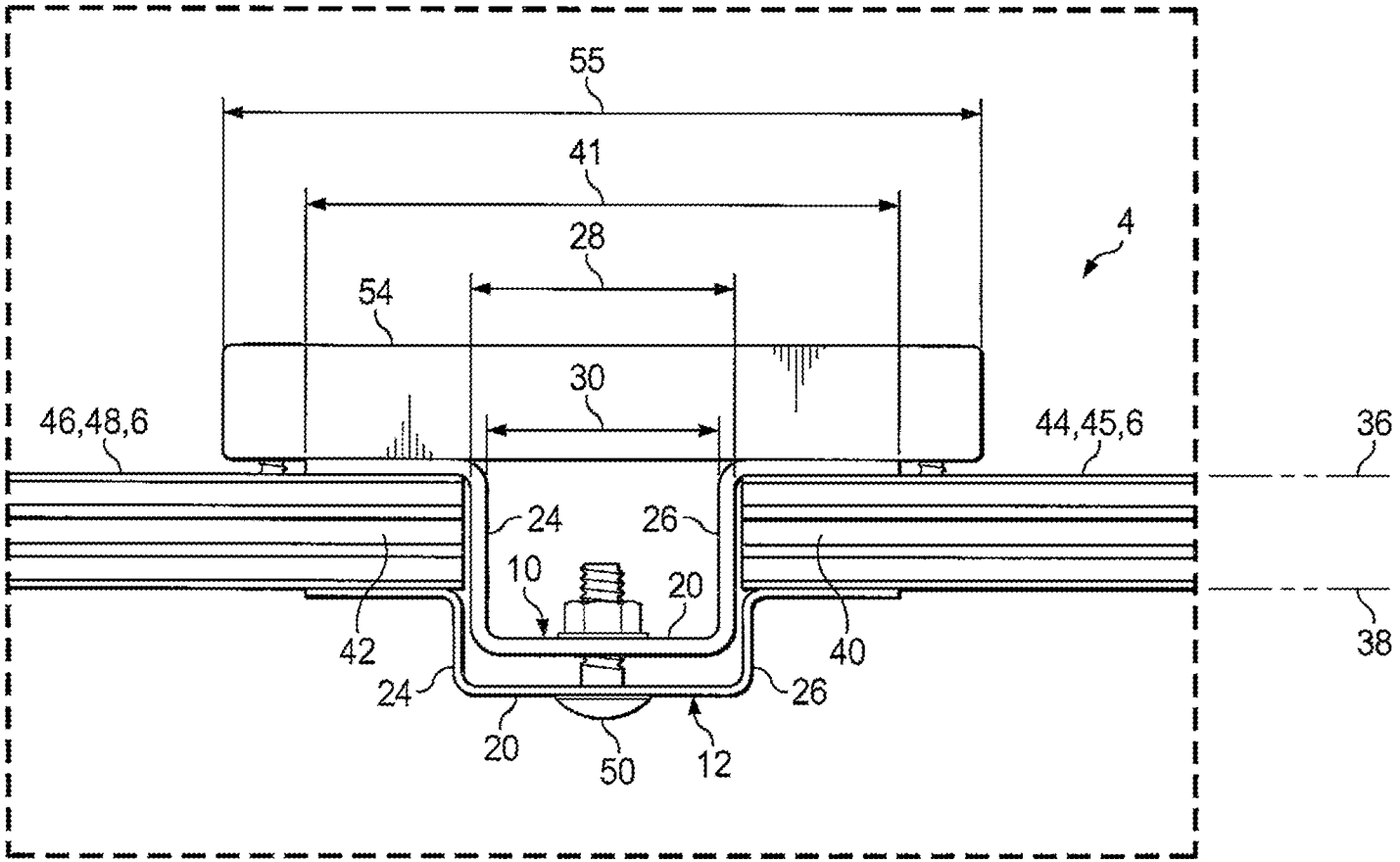
FIG. 5, which is an enlargement of the section 5-5 shown in FIG. 4, is a top view of an embodiment 4 of the fence post assembly provided by the present invention.
Figure 6:
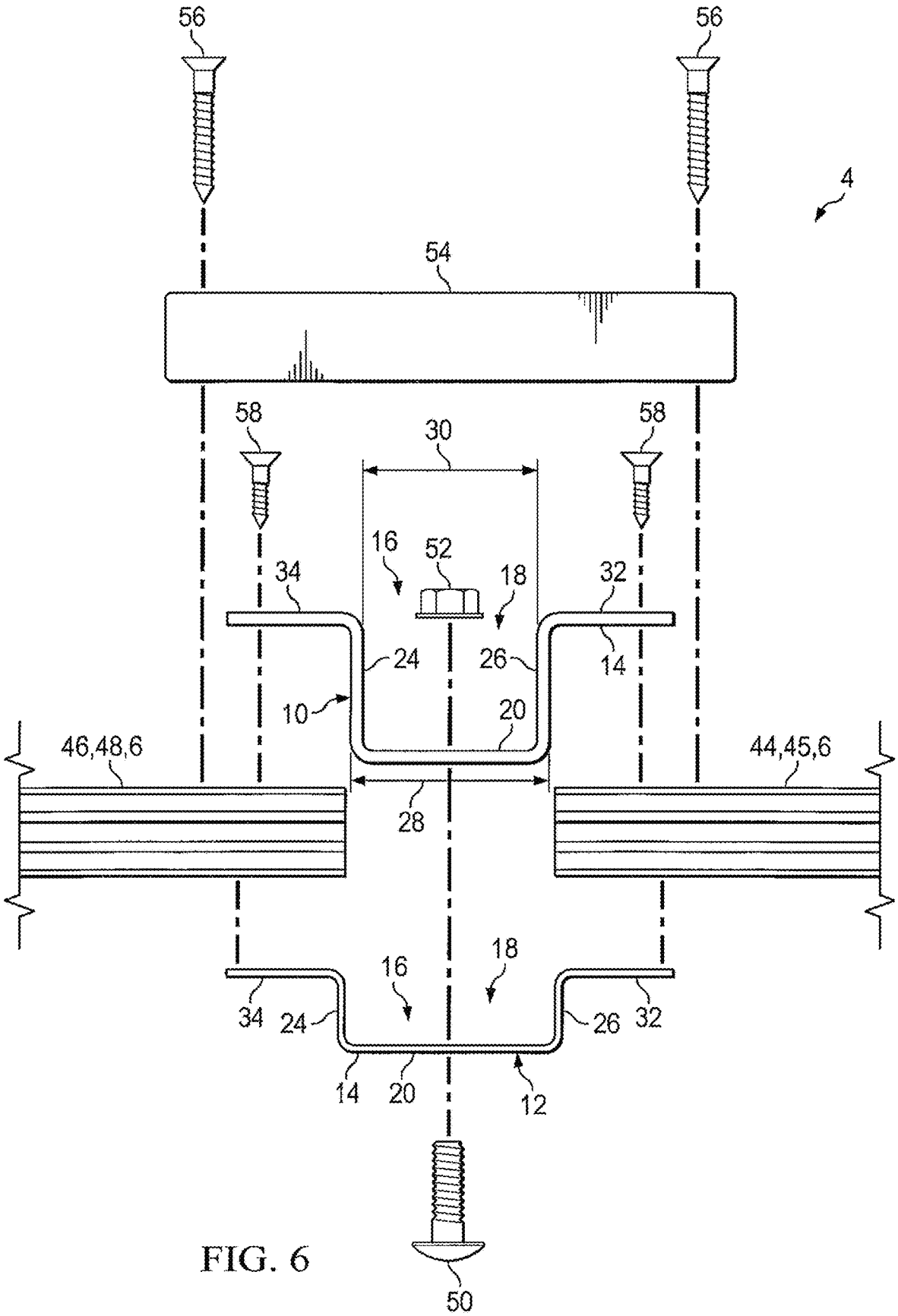
FIG. 6 is an exploded top view of the inventive fence post assembly 4.

In the inventive fence system 2 illustrated in FIGS. 1 and 2, the horizontal segment 45 of fence filler material 6 extends between the fence post assemblies **4*a* and 4*b* so that (i) the right end or edge portion 44 of the segment 45 of filler material 6 is received and held in the left side gap 40 of the fence post assembly 4***b* as described above and (ii) the opposite left end or edge portion of the segment 45 of filler material 6 is received and held in the right side gap 42 of the fence post assembly 4*a*.

Similarly, the horizontal segment 48 of fence filler material 6 extends between the fence post assemblies 4*b* and 4*c* so that (i) the left end or edge portion 46 of the segment 48 of fence filler material 6 is received and held in the right side gap 42 of the fence post assembly 4*b* and (ii) the opposite right end or edge portion of the segment 48 of filler material 6 is received and held in the left side gap 40 of the fence post assembly 4*c*.

Thus, the present invention is well adapted to carry out the objects and attain the ends and advantages mentioned above as well as those inherent therein. While presently preferred embodiments have been described for purposes of this disclosure, numerous changes and modifications will be apparent to those in the art. Such changes and modifications are encompassed within the invention as described herein and as set forth in the claims.

What is claimed is:

1. A fence post assembly comprising:

an inner hat-channel member;

an outer hat-channel member;

each of the inner and the outer hat-channel members comprising a U-shaped channel which extends longitudinally from a lower end to an upper end of the hat-channel member, the U-shaped channel having (i) a longitudinally extending channel opening in a forward face of the hat-channel member and (ii) a longitudinally extending back wall opposite the longitudinally extending channel opening, and longitudinally extending left and right side flanges which project outwardly on opposite left and right sides of the longitudinally extending channel opening of the U-shaped channel;

the U-shaped channel of the inner hat-channel member having an outer lateral width that is less than an inner lateral width of the U-shaped channel of the outer hat-channel member; and at least a longitudinal portion of the back wall of the U-shaped channel of the inner hat-channel member being received in the longitudinally extending channel opening of the U-shaped channel of the outer hat-channel member, and nesting in the U-shaped channel of the outer hat-channel member, to form (i) a first longitudinally extending side gap, between the left side flange of the inner hat-channel member and the left side flange of the outer hat-channel member, for receiving a fence filler material and (ii) a second longitudinally extending side gap, between the right side flange of the inner hat-channel member and the right side flange of the outer hat-channel member, for receiving a fence filler material.

2. The fence post assembly of claim 1 further comprising:

the longitudinally extending back wall of the U-shaped channel of the inner hat-channel member being flat and the longitudinally extending back wall of the U-shaped channel of the outer hat-channel member being flat.

3. The fence post assembly of claim 1 further comprising:

the left and right side flanges of the inner hat-channel member being coplanar and the left and right side flanges of the outer hat-channel member being coplanar.

4. The fence post assembly of claim 3 further comprising:

the left and right side flanges of the inner hat-channel member lying in a first plane and the left and right side flanges of the outer hat-channel member lying in a second plane which is parallel to and spaced apart from the first plane.

5. The fence post assembly of claim 1 further comprising a plurality of bolts which extend through the longitudinally extending back wall of the U-shaped channel of the outer hat-channel member and the longitudinally extending back wall of the U-shaped channel of the inner hat-channel member.

6. The fence post assembly of claim 5 further comprising a panel, board, or plank which is positioned over a longitudinally extending portion of the forward face of the inner hat-channel member and which conceals the longitudinally extending portion of the forward face of the inner hat-channel member and the bolts.

7. A fence comprising:

a fence post assembly comprising an inner hat-channel member and an outer hat-channel member, each of the inner and the outer hat-channel members comprising a U-shaped channel which extends longitudinally from a lower end to an upper end of the hat-channel member, the U-shaped channel having (i) a longitudinally extending channel opening in a forward face of the hat-channel member and (ii) a longitudinally extending back wall opposite the longitudinally extending channel opening and longitudinally extending left and right side flanges which project outwardly on opposite left and right sides of the longitudinally extending channel opening of the U-shaped channel;

the U-shaped channel of the inner hat-channel member having an outer lateral width that is less than an inner lateral width of the U-shaped channel of the outer hat-channel member;

at least a longitudinal portion of the back wall of the U-shaped channel of the inner hat-channel member being received in the longitudinally extending channel opening of the U-shaped channel of the outer hat-channel member, and nesting in the U-shaped channel of the outer hat-channel member, to form (i) a longitudinally extending left side gap between the left side flange of the inner hat-channel member and the left side flange of the outer hat-channel member and (ii) a longitudinally extending right side gap between the right side flange of the inner hat-channel member and the right side flange of the outer hat-channel member;

a first fence filler material having an end portion or edge portion which is received in the left side gap; and a second fence filler material having an end portion or edge portion which is received in the right side gap, the second fence filler material being of a same type as, or different from, the first fence filler material.

8. The fence of claim 7 further comprising:

the first fence filler material comprising a vertical series of horizontal boards, planks, or panels and the second fence filler material comprising a vertical series of horizontal boards, planks, or panels.

9. The fence of claim 7 further comprising:

the longitudinally extending back wall of the U-shaped channel of the inner hat-channel member being flat and the longitudinally extending back wall of the U-shaped channel of the outer hat-channel member being flat.

10. The fence of claim 7 further comprising:

the left and right side flanges of the inner hat-channel member being coplanar and the left and right side flanges of the outer hat-channel member being coplanar.

11. The fence of claim 10 further comprising:

the left and right side flanges of the inner hat-channel member lying in a first plane and the left and right side flanges of the outer hat-channel member lying in a second plane which is parallel to and spaced apart from the first plane.

12. The fence of claim 7 further comprising a plurality of bolts which extend through the longitudinally extending back wall of the U-shaped channel of the outer hat-channel member and the longitudinally extending back wall of the U-shaped channel of the inner hat-channel member.

13. The fence of claim 12 further comprising a cover formed of a panel, board, or plank which is positioned over a longitudinally extending portion of the forward face of the inner hat-channel member and which conceals the longitudinally extending portion of the forward face of the inner hat-channel member and the bolts.

14. The fence of claim 13 further comprising:

a plurality of screws which extend through a left edge portion of the cover into the first fence filler material and a plurality of screws which extend through a right edge portion of the cover into the second fence filler material.

15. The fence of claim 12 further comprising:

a plurality of screws which extend through the left side flange of the inner hat-channel member into the end portion or edge portion of the first fence filler material and a plurality of screws which extend through the right side flange of the inner hat-channel member into the end portion or edge portion of the second fence filler material.

16. A fence comprising:

a first fence post assembly and a second fence post assembly, each of the first fence post assembly and the second fence post assembly comprising an inner hat-channel member and an outer hat-channel member, and each of the inner and outer hat-channel members comprising a U-shaped channel which extends longitudinally from a lower end to an upper end of the hat-channel member, the U-shaped channel having (i) a longitudinally extending channel opening in a forward face of the hat-channel member and (ii) a longitudinally extending back wall opposite the longitudinally extending channel opening and longitudinally extending left and right side flanges which project outwardly on opposite left and right sides of the longitudinally extending channel opening of the U-shaped channel;

for each of the first fence post assembly and the second fence post assembly, the U-shaped channel of the inner hat-channel member having an outer lateral width that is less than an inner lateral width of the U-shaped channel of the outer hat-channel member;

for each of the first fence post assembly and the second fence post assembly, at least a longitudinal portion of the back wall of the U-shaped channel of the inner hat-channel member being received in the longitudinally extending channel opening of the U-shaped channel of the outer hat-channel member, and nesting in the U-shaped channel of the outer hat-channel member, to form (i) a longitudinally extending left side gap between the left side flange of the inner hat-channel member and the left side flange of the outer hat-channel member and (ii) a longitudinally extending right side gap between the right side flange of the inner hat-channel member and the right side flange of the outer hat-channel member; and a fence filler material having a left end portion or edge portion which is received in the right side gap of the first fence post assembly and a right end portion or edge portion which is received in the left side gap of the second fence post assembly.

17. The fence of claim 16 further comprising:

the fence filler material being a first fence filler material;

a second fence filler material having a right end portion or edge portion which is received in the left side gap of the first fence post assembly;

a third fence filler material having a left end portion or edge portion which is received in the right side gap of the second fence post assembly;

the second fence filler material being of a same type as, or different from, the first fence filler material;

the third fence filler material being of a same type as, or different from, the first fence filler material; and the third fence filler material being of a same type as, or different from, the second fence filler material.

18. The fence of claim 17 further comprising the first fence filler material, the second fence filler material, and the third fence filler material each comprising a vertical series of horizontal boards, planks, or panels.

19. The fence of claim 16 further comprising for each of the first fence post assembly and the second fence post assembly:

the longitudinally extending back wall of the U-shaped channel of the inner hat-channel member being flat;

the longitudinally extending back wall of the U-shaped channel of the outer hat-channel member being flat;

the left and right side flanges of the inner hat-channel member being coplanar;

the left and right side flanges of the outer hat-channel member being coplanar; and a plurality of bolts which extend through the longitudinally extending back wall of the U-shaped channel of the outer hat-channel member and the longitudinally extending back wall of the U-shaped channel of the inner hat-channel member.

20. The fence of claim 19 further comprising, for each of the first fence post assembly and the second fence post assembly, a cover formed of a panel, board, or plank which is positioned over a longitudinally extending portion of the forward face of the inner hat-channel member and which conceals the longitudinally extending portion of the forward face of the inner hat-channel member and the bolts.

* * * * *